US005113905A

United States Patent [19]

Pruitt et al.

[11] Patent Number: 5,113,905

[45] Date of Patent: * May 19, 1992

[54] CARBON DIOXIDE FILL MANIFOLD AND METHOD

[75] Inventors: John E. Pruitt, Weatherford; John A. Pruitt, Perrin; Jay L. Pruitt, Arlington, all of Tex.

[73] Assignee: Michael D. Hoyle, Arlington, Tex.

[ * ] Notice: The portion of the term of this patent subsequent to Jun. 26, 2007 has been disclaimed.

[21] Appl. No.: 498,717

[22] Filed: Mar. 26, 1990

Related U.S. Application Data

[63] Continuation-in-part of Ser. No. 328,614, Mar. 27, 1989, Pat. No. 4,936,343.

[51] Int. Cl.[5] ..... F17C 7/04

[52] U.S. Cl. ..... 137/571; 137/539; 62/50.2; 141/1

[58] Field of Search ..... 137/255, 571, 572, 587, 137/539; 222/3; 62/48.1, 50.2, 50.4, 384, 388; 141/1

[56] References Cited

U.S. PATENT DOCUMENTS

| | | | |
|---|---|---|---|
| 1,062,343 | 5/1913 | Mahoney | 137/587 X |
| 2,363,200 | 11/1944 | Pew et al. | 62/50.2 |
| 2,469,434 | 5/1949 | Hansen et al. | 62/50.2 |
| 2,479,070 | 8/1949 | Hansen | 62/50.2 |
| 3,093,974 | 6/1963 | Templer et al. | 62/50.2 |
| 3,149,697 | 9/1964 | Bendeich et al. | 137/539 X |
| 3,392,537 | 7/1968 | Woerner | 62/50.2 |
| 3,542,155 | 11/1970 | Kern et al. | 137/539 X |
| 3,712,073 | 1/1973 | Arenson | 62/50.2 |
| 3,990,256 | 11/1976 | May et al. | 62/50.2 |
| 4,321,796 | 3/1982 | Kohno | 62/50.2 |
| 4,683,921 | 8/1987 | Neeser | 141/1 |

*Primary Examiner*—John Rivell
*Attorney, Agent, or Firm*—John M. Harrison

[57] ABSTRACT

A carbon dioxide fill manifold and method for using which is designed to provide a end-user with an uninterrupted supply of carbon dioxide gas, while at the same time eliminating the necessity of transporting individual, conventional pressurized bottles to be refilled. In a most preferred embodiment the carbon dioxide fill manifold includes a fill line valve connected to an atomizer for receiving a fill line and introducing liquid carbon dioxide into the atomizer, liquid cylinder ports provided in the atomizer for connecting a pair of liquid chambers to the atomizer and receiving and storing the liquid carbon dioxide, a gas cylinder port provided in the atomizer for connecting a vapor container to the atomizer and receiving gaseous carbon dioxide generated in the atomizer and a service line valve also connected to the atomizer for receiving a service lien valve and servicing the end user with gaseous carbon dioxide. A pressure actuated valve is also provided in the atomizer for periodically replenishing the supply of gaseous carbon dioxide from the liquid containers responsive to a selected pressure differential across the pressure actuated valve. A pressure relief valve is seated in the atomizer to guard against excessive liquid carbon dioxide system pressure.

30 Claims, 1 Drawing Sheet

CARBON DIOXIDE FILL MANIFOLD AND METHOD

CROSS-REFERENCE TO RELATED APPLICATIONS

This application is a continuation-in-part of our copending U.S. patent application Ser. No. 07/328,614, filed Mar. 27, 1989, now U.S. Pat. No. 4,936,343.

BACKGROUND OF THE INVENTION

1. Field of the Invention

This invention relates to gas transfer systems and more particularly, to a carbon dioxide fill manifold and method for using the fill manifold for handling liquid and gaseous carbon dioxide and dispensing the gaseous carbon dioxide to an end-user, such as a carbonated drink-dispensing system. The carbon dioxide fill manifold of this invention is characterized by a fill line valve attached to an atomizer and receiving a fill line for introducing liquid carbon dioxide into the atomizer, at least two liquid cylinder ports provided in the atomizer for receiving corresponding liquid chambers or cylinders and receiving and storing liquid carbon dioxide, at least one gas cylinder port also connected to the atomizer for receiving a corresponding gas cylinder and storing gaseous carbon dioxide generated in the atomizer and a gas service valve connected to the atomizer for receiving a gas service line and supplying gaseous carbon dioxide on demand to an end user. A pressure actuated valve is also provided in the atomizer between the liquid cylinder ports and the gas cylinder port(s) to facilitate automatic dispensing of liquid carbon dioxide from the liquid cylinders through the atomizer, where it vaporizes and expands into gaseous carbon dioxide for storage in the gas cylinder(s) and is ultimately dispensed to an end-user. A pressure relief valve port is also provided in the atomizer for receiving a pressure relief valve to prevent excessive system pressure in the atomizer. The carbon dioxide fill manifold is designed to handle both liquid and gaseous carbon dioxide and to provide a substantially uninterrupted supply of gaseous carbon dioxide to an end-user such as a carbonated drink dispenser, without the necessity of transporting conventional carbon dioxide pressure vessels or cylinders to and from the end-user site.

The carbon dioxide fill manifold of this invention is designed to provide a selected number of liquid bottles, chambers or cylinders and corresponding vapor bottles, chambers or cylinders connected by an atomizer fitted with an internal pressure-regulated check valve, to facilitate an appropriate ratio of gas to liquid in the system. After filling of the liquid cylinder or cylinders is completed according to the method of this invention, the customer or end-user will draw gas from the vapor cylinder(s). When a predetermined volume of gaseous carbon dioxide has been used from these vapor cylinder(s) by the customer to create a predetermined pressure differential in the pressure actuated valve located in the atomizer, the pressure-actuated valve will automatically open to facilitate a flow of additional liquid carbon dioxide into the atomizer. This liquid carbon dioxide rapidly expands into a gas and enters the vapor cylinder(s), in order to refill the vapor cylinder(s). The gas evolution process continues in the atomizer until the preselected pressure differential at the pressure actuated valve has been equalized and the pressure actuated valve then closes. A primary feature of the carbon dioxide fill manifold and method of this invention is the capacity for refilling both the liquid cylinder(s) and the vapor cylinder(s) without disconnecting these vessels from the supply and service lines, respectively. Since the liquid cylinder (s) and vapor cylinder(s) are filled by volume instead of by weight, the need to transport, handle and weigh the various carbon dioxide-containing vessels is eliminated.

A common method of providing an end-user such as a carbonated drink dispensing apparatus with carbon dioxide gas involves the use of high pressure containers, bottles or cylinders which are manufactured in various sizes, typically 20 and 50 pound quantities, wherein the weight designation refers to the weight of the carbon dioxide in the cylinders at full capacity. These cylinders are typically filled by weight instead of volume, since a portion of each cylinder (approximately 32%) must be reserved for expansion of the carbon dioxide into the vapor phase, in order to maintain an appropriate volume of liquid at a desired pressure. The problem of furnishing cylinders of uniform weight and carbon dioxide volume is amplified by the fact that there is no uniform weight or tare among the cylinders themselves. The cylinders are typically filled by placing them on a scale and charging them with liquid carbon dioxide until the desired weight of liquid carbon dioxide is injected therein. Accordingly, the carbon dioxide supplier must periodically interrupt the customer supply, in order to exchange a full vessel for the empty one, using this system. The empty cylinders must then be transported to a warehouse for weighing and refilling and the cycle is repeated. Expansion of a small amount of the carbon dioxide liquid into the gas phase exerts the necessary vapor pressure to maintain a proper gas-liquid balance in these cylinders, to assure proper dispensing of carbon dioxide gas to the end-user. These conventional carbon dioxide supply cylinders are typically equipped with a pressure disc which is designed to rupture if the pressure inside the cylinder rises beyond a specified level. Overfilling, that is, charging liquid carbon dioxide into that portion of the cylinder which is normally reserved for gas expansion purposes, will sometimes cause this disc to burst, an occurrence which is both dangerous and wasteful.

1. Description of the Prior Art

Various types of liquid and gaseous vapor-containing and handling systems are well known to those in the art. A "Fluid Medium Storing and Dispensing System" is detailed in U.S. Pat. No. 2,412,613, dated Dec. 17, 1946, to H. C. Grant, Jr. The patent details one or more receptacles or containers for storing a high-pressure fluid medium such as liquified carbon dioxide. Further included is a fluid medium retaining and releasing apparatus associated with each of the containers, which apparatus is adapted to be operated by the fluid medium from one or more containers in the system. A suitable actuating device which is operable by a relatively small force for initiating simultaneous release of the fluid medium from one or more of the containers, is also provided U.S. Pat. No. 2,492,165, dated Dec. 27, 1949, to D. Mapes, details a "System for Dispensing Fluids". The system includes multiple receptacles containing a fluid under pressure, apparatus provided in each of the receptacles for normally retaining a fluid therein, which apparatus operates to release the fluid from the receptacles, delivery means into which the fluid may be delivered from all the receptacles and a fluid-actuated operating device for operating the retaining apparatus of each receptacle. Apparatus for conducting fluid from the delivery means to the operating apparatus with at least one of the receptacles is also provided. A "Pneumatic Installation" is detailed in U.S. Pat. No. 2,591,641, dated Apr. 1, 1952, to J. Troendle. The installation includes one or more sources of compressed air, one or more devices to be fed with compressed air for pneumatic control purposes, several compressed air reservoirs and conduits connecting the various elements to each other. U.S. Pat. No. 3,760,834, dated Sept. 25, 1973, to David E. Shonerd, et al, details a "Reservoir for Pressurized Fluids". The reservoir includes multiple, straight tubes located in side-by-side relationship and surrounded by a single, elongated tube of substantially less diameter which is helically wound about the straight tubes to define a reservoir for pressurized natural gas. The helically-wound tube serves both as a protective covering and a strengthening structure for the straight tubes. The straight tubes and helically-wound tubes may be interconnected by suitable manifolding and a fill opening is provided for storing pressurized fluid therein. U.S. Pat. No. 1,062,343, dated May 20, 1913, to James H. Mahoney, details an "Apparatus for Dispensing Carbonated Beverages" such as beer, which includes a mechanism for reducing gas pressure while dispensing the liquid, to prevent undue foaming. U.S. Pat. No. 2,363,200, dated Nov. 21, 1944, to P. B. Pew, et al, details an "Apparatus for Dispensing Gas Material". The apparatus includes a system having an arrangement for storing and gasifying relatively large quantities of liquified gas such as liquid oxygen, in order to service large instantaneous demands. An "Apparatus and Method for Filling Gas Storage Cylinders" is detailed in U.S. Pat. No. 2,469,434, dated May 10, 1949, to O. A. Hansen, et al. The patented invention includes a mobile unit which includes a transport truck having a tailgate adapted to provide a temporary station for gas storage containers which are to be evacuated and filled with a gas material such as oxygen, in the gas phase. Suitable equipment is also provided on the truck for first evacuating and then charging the containers at the temporary station from a source such as a container in the liquid phase, which source is also mounted on the truck, together with the necessary apparatus for converting the gas material from the liquid to the gas phase. U.S. Pat. No. 2,479,070, dated Aug. 16, 1949, also to O. A. Hansen, details an "Apparatus for and Method of Dispensing Liquified Gases". The apparatus includes a pair of pressure containers for storing liquified gases, pressure regulating apparatus for maintaining the pressure in the containers above a predetermined value, a liquid line extending externally of the containers, with a heater provided in the liquid line and a pressure sensitive valve connected to the containers for controlling the flow of liquid in the containers. An "Apparatus for Storing and Dispensing Liquified Gases" is detailed in U.S. Pat. No. 3,093,974, dated Jun. 18, 1963, to C. E. Templer, et al. The apparatus includes a storage container for storing and dispensing a liquified gas, a liquid withdrawal pipe opening at a point near the bottom of the container and extending through the top thereof and a liquid feed line connecting the liquid withdrawal pipe to one end of a pressure raising coil located below the level of the bottom of the container. Further included is a vapor feed line connecting the other end of the pressure raising coil with the vapor space of the container through an automatic valve which is arranged to open when the pressure in the container falls below a predetermined value. A jacket surrounding that part of the liquid feed line above the level of the container, is also provided, the jacket having a connection to the liquid withdrawal pipe through a valve arranged to maintain a pressure drop between the liquid feed line and the jacket and the liquid service connection. A "Liquid Cylinder System" is detailed in U.S. Pat. No. 3,392,537, dated Jul. 16, 1968, to R. C. Woerner. The patent is directed to a distribution system for a vaporizable liquid, in which the liquid is stored in individual storage containers and is dispensed under pressure. A pressurizing system is associated with at least one of the storage containers to maintain a desired pressure in the system. U.S. Pat. No. 3,712,073, dated Jan. 23, 1973, to Edwin M. Arenson, details a "Method and Apparatus for Vaporizing and Superheating Cryogenic Fluid Liquid". The apparatus includes a closed vessel for heating medium liquid such that portions thereof are continuously vaporized. The stream of cryogenic fluid to be vaporized and superheated is passed through a heating coil disposed within the vessel and in heat exchange relationship with both the liquid and vapor portions of the heating minimum, so that the cryogenic fluid is vaporized and superheated to a desired level and the vaporized heating medium is continuously condensed and returned to the liquid portion thereof. U.S. Pat. No. 3,990,256, dated Nov. 9, 1976, to Walter G. May, et al, details a "Method of Transporting Gas", which method includes pumping liquified natural gas for a predetermined portion of the desired distance, applying processes in which the refrigeration value of the gas is utilized and the high boiling point components are separated, and subsequently vaporizing the remaining liquid prior to transporting the vapor by pipeline in the gaseous phase. U.S. Pat. No. 4,321,796, dated Mar. 30, 1982, to N. Kohno, details an "Apparatus for Evaporating Ordinary Temperature Liquified Gases". The apparatus includes an ordinary temperature liquified gas storing vessel, an evaporating chamber for evaporating a liquified gas and a liquid level detecting chamber for detecting the liquid level in the evaporating chamber. The detecting chamber is disposed between the storage vessel and the evaporating chamber and the liquid outlet from the storage vessel and detecting chamber are connected by conduit equipped with a liquid pressure reducing valve. The bottom of the detecting chamber and the liquid inlet to the evaporating chamber are connected by a liquid conduit and the respective gas outlets from the detecting chamber and the evaporating chamber are connected to a gas warming chamber. A "Carbonated Beverage Storage and Dispensing System and Method" is detailed in U.S. Pat. No. 4,683,921, dated Aug. 4, 1987, to Timothy A. Neeser. The system employs separate tanks for carbon dioxide and syrup and mixing occurs during dispensing. For each type of syrup there are preferably two syrup supply tanks and each syrup supply tank may be selectively connected to either a syrup filling source or to a sanitizing system for cleaning the tank. The system allows one of the syrup supply tanks to be sanitized or refilled, while the other supplies syrup for dispensing, thus allowing uninterrupted beverage service.

It is an object of this invention to provide a carbon dioxide fill manifold which is designed to provide an end-user with a substantially uninterrupted supply of carbon dioxide gas, while at the same time eliminating the necessity for transporting individual conventional bottles, containers or cylinders for refilling purposes.

Another object of the invention is to provide an on-site carbon dioxide refilling apparatus characterized by a fill manifold for connecting liquid and gaseous carbon dioxide cylinders and a method for automatically transferring the liquid carbon dioxide from the liquid cylinders to the gaseous cylinders where it is vaporized and dispensing the gaseous carbon dioxide to an end user, wherein the quantity of the gas distributed is determined by volume, rather than by weight.

Yet another object of this invention is to provide a new and improved carbon dioxide fill manifold which is designed for on-site use to facilitate connection of multiple liquid chamber bottles and companion vapor chamber bottles using a pressure-actuated atomizer, wherein an end-user or customer is supplied with a substantially uninterrupted source of carbon dioxide gas at a desired pressure.

Another object of the invention is to provide a carbon dioxide fill manifold which includes an atomizer containing a pressure actuated check valve to periodically automatically vaporize a charge of liquid carbon dioxide from a pair of liquid carbon dioxide storage bottles or cylinders connected to the atomizer for storage in a single gaseous carbon dioxide storage bottle also connected to the atomizer and dispensing in the gaseous phase to an end-user.

Still another object of this invention is to provide a carbon dioxide fill manifold which is characterized by a fill line valve and service line valve constructed from high pressure material and connected to a vaporizer or atomizer, connection ports for connecting a selected number of liquid chambers or cylinders and vapor cylinders to the atomizer and a pressure actuated check valve provided in the atomizer between the liquid and gas cylinder connection ports, wherein the total volume of the vapor cylinders represents approximately one-third of the total volume of the liquid chambers and gas cylinders and liquid carbon dioxide is introduced into the fill line to fill the liquid chambers and the liquid carbon dioxide is periodically vaporized into gaseous carbon dioxide in the atomizer responsive to a selected pressure differential across the atomizer, for dispensing to a customer.

Still another object of this invention is to provide a new and improved carbon dioxide fill manifold and method for storing liquid and gaseous carbon dioxide and dispensing carbon dioxide gas to a customer or end-user on a volume, rather than a weight basis and thereby eliminating the necessity of using multiple conventional individual carbon dioxide bottles or cylinders which must be periodically returned to a plant and refilled.

Another object of the invention is to provide a method of storing liquid and gaseous carbon dioxide and dispensing the gaseous carbon dioxide to a customer on demand, which method includes the steps of charging the liquid carbon dioxide into a pair of liquid chambers, allowing the liquid carbon dioxide to flow from the liquid chambers into an atomizer responsive to a selected pressure differential across the atomizer and vaporizing the carbon dioxide for storage in a gaseous chamber.

SUMMARY OF THE INVENTION

These and other objects of the invention are provided in a new and improved carbon dioxide fill manifold which is characterized in a preferred embodiment by a fill line valve connected to a vaporizer or atomizer and fitted with a fill line for receiving a charge of liquid carbon dioxide; a pair of liquid cylinder ports for connecting liquid cylinders to the atomizer for receiving and dispensing the liquid carbon dioxide; a gas cylinder port for connecting a gas cylinder to the atomizer; a pressure actuated valve provided in the atomizer between the liquid cylinder ports and gas cylinder port; and a service line valve fitted with a customer service line, also connected to the atomizer for receiving liquid carbon dioxide vaporized in the atomizer and the gas cylinder responsive to a pressure differential between the liquid cylinders and the gas cylinder. A method for handling and dispensing liquid and gaseous carbon dioxide by the steps of charging liquid carbon dioxide in a pair of liquid carbon dioxide containers, vaporizing the liquid carbon dioxide on demand in an atomizer and a vapor cylinder and subsequently distributing the gaseous carbon dioxide on demand to an end-user, responsive to operation of a pressure actuated check valve provided in the atomizer at a selected pressure differential determined by the difference in pressure between the liquid and gaseous carbon dioxide cylinders.

BRIEF DESCRIPTION OF THE DRAWING

The invention will be better understood by reference to the accompanying drawing, wherein.

DESCRIPTION OF THE PREFERRED EMBODIMENTS

Figure 1:
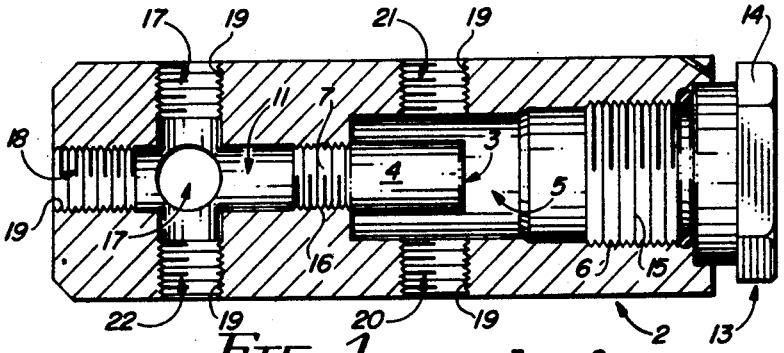
FIG. 1 is a sectional view of a preferred embodiment of the atomizer element of the carbon dioxide fill manifold of this invention.
Figure 2:
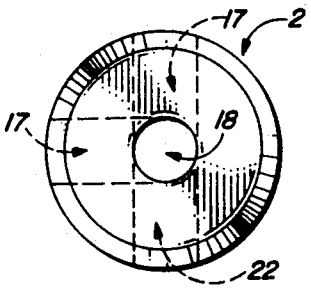
FIG. 2 is a left end view of the atomizer illustrated in FIG. 1.
Figure 5:
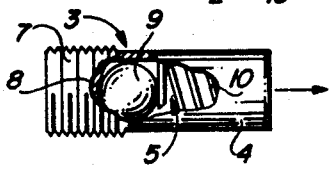
FIG. 5 is a side sectional view of a pressure actuated valve provided in the atomizer illustrated in FIG. 1.
Figure 3:
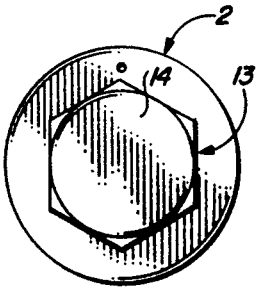
FIG. 3 is a right end view of the opposite end of the atomizer illustrated in FIG. 1.
Figure 4:
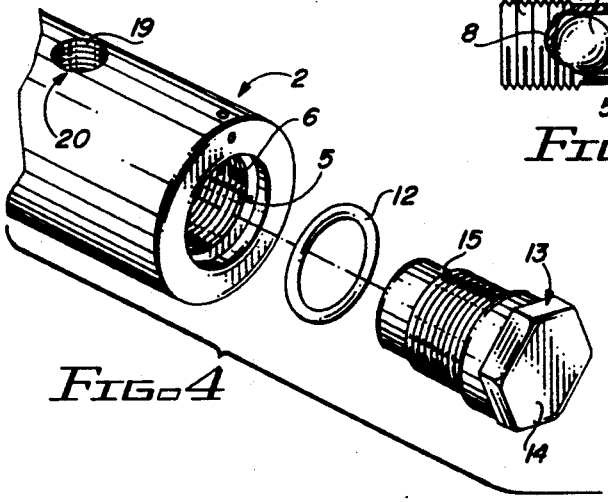
FIG. 4 is a perspective, exploded view, partially in section, of the opposite end of the atomizer illustrated in FIGS. 1 and 3.
Figure 6:
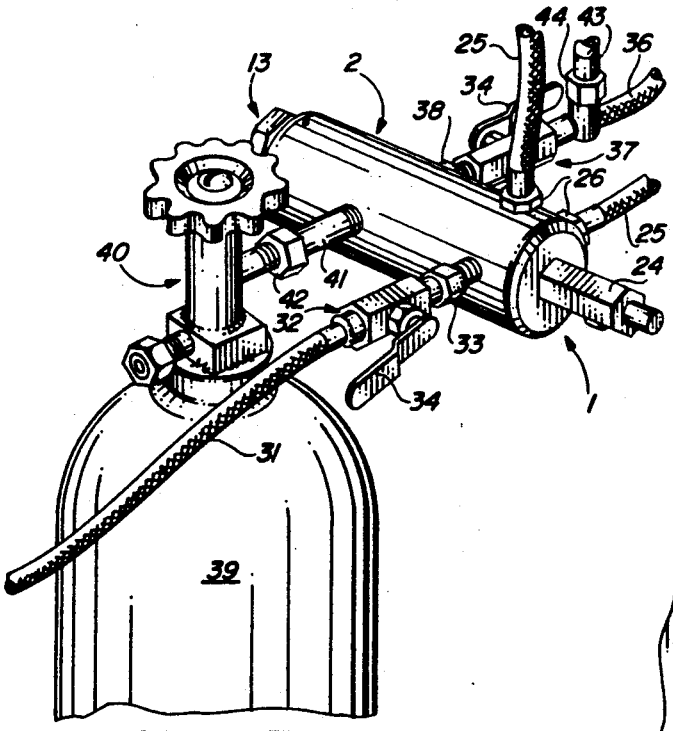
FIG. 6 is a perspective view of the carbon dioxide fill manifold rotated 90 degrees from the position illustrated in FIGS. 1 and 2, attached to a gas cylinder.
Figure 7:
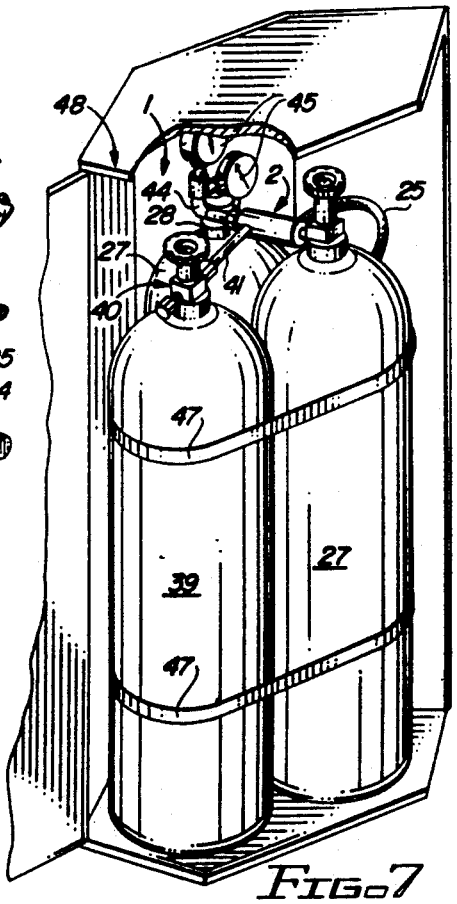
FIG. 7 is a perspective view of the carbon dioxide fill manifold coupled to two liquid cylinders and the gas cylinder illustrated in FIG. 6.

Referring initially to FIGS. 6 and 7 of the drawing, the carbon dioxide fill manifold of this invention is generally illustrated by reference numeral 1. As further illustrated in FIG. 1, the carbon dioxide fill manifold 1 is characterized by a generally cylindrically-shaped atomizer 2, having a plug 13 threaded in one end against an 0-ring 12 for sealing purposes, and a pressure relief valve 24 is threaded in the opposite end. As further illustrated in FIG. 1, the atomizer 2 is further characterized by a housing bore 5, fitted with internal bore threads 6 for receiving the plug threads 15 of the plug 13, which plug 13 is further provided with a hexagonal plug head 14. A smaller valve bore 11 is provided in the atomizer 2 in communication with the housing bore 5 and a pair of liquid cylinder ports 17 are also provided in the atomizer 2 transversely at right angles with respect to each other, in communication with the valve bore 11. A liquid service line port 22 is similarly located in transverse configuration in the atomizer 2 and is also provided in communication with the valve bore 11. As illustrated in FIG. 6, the pressure relief valve 24 is threadably seated in a pressure relief valve port 18, located in the end of the atomizer 2 opposite the plug 13 and the pressure relief valve port 18 also communicates with the valve bore 11. A gas cylinder port 20 is further provided transversely in the housing of the atomizer 2 in spaced relationship with respect to the liquid cylinder ports 17 and liquid service line port 22 and communicates with the housing bore 5, while a gas service line port 21 is oppositely-disposed from the gas cylinder port 20 in the atomizer 2 and also communicates with the housing bore 5. Each of the liquid cylinder ports 17, pressure relief valve port 18, gas cylinder port 20, gas service line port 21 and liquid service line port 22 are provided with internal port threads 19, for connecting various manifold fittings and components, as hereinafter further described. As illustrated in FIGS. 1 and 5, a pressure actuated valve 3 is characterized by a generally cylindrically-shaped valve housing 4, having one end fitted with housing threads 7. The housing threads 7 are seated in corresponding valve bore threads 16, provided in the valve bore 11 of the atomizer 2, in order to threadably seat the pressure actuated valve 3 in the housing bore 5 with the discharge end of the pressure actuated valve 3 projecting into the valve bore 11, as illustrated in FIG. 1. As illustrated in FIG. 6, line fittings 26 are threadably inserted in the respective liquid cylinder ports 17 of the atomizer 2, in order to mount flexible liquid pressure cylinder lines 25 therein, respectively. The liquid pressure cylinder lines 25 are connected to liquid cylinder valves 28, mounted on the two liquid cylinders 27, respectively, as illustrated in FIG. 7. Similarly, a gas cylinder nipple 41 is threadably inserted in the gas cylinder port 20, illustrated in FIG. 1, downstream from the pressure actuated valve 3, for attachment to the corresponding gas cylinder valve fitting 42 of a gas cylinder valve 40, mounted on a single gas cylinder 39, as further illustrated in FIG. 6. In like manner, a liquid service valve fitting 33 is threadably inserted in the liquid service line port 22 of the atomizer 2 upstream from the pressure actuated valve 3 and secures a liquid service valve 32 to the atomizer 2. A flexible liquid service line 31 is attached to the liquid service valve 32 for receiving liquid carbon dioxide and filling the liquid cylinder 27, as hereinafter further described. Similarly, a gas service valve fitting 38 is threadably inserted in the gas service line port 21 of the atomizer 2, for attaching a gas service valve 37 and a gas service line 36 to the atomizer 2 downstream from the pressure actuated valve 3. The gas service line 36 may be attached to customer cylinders or containers (not illustrated) for filling these containers or cylinders with gaseous carbon dioxide, as further hereinafter described. Each of the liquid service valve 32 and the gas service valve 37 are fitted with conventional valve handles 34, for manipulating the liquid service valve 32 and the gas service valve 37 into open and closed positions, respectively. A pressure gauge fitting 44 is mounted in the gas service line 36 downstream from the gas service valve 37, in order to mount a pressure gauge nipple 43 and a pair of pressure gauges 45 and monitor the pressure of the gaseous carbon dioxide entering the customer's containers or cylinders through the gas service line 36, as illustrated in FIGS. 6 and 7.

Referring now to FIGS. 1 and 5 of the drawing, the pressure actuated valve 3 is provided with a longitudinal housing bore 5, having a curved housing seat 8 provided therein, a ball 9 disposed in the housing bore 5 adjacent to the housing seat 8 and a coil spring 10, also positioned in the housing bore 5 and contacting the ball 9, such that the ball 9 normally fits in the housing seat 8 to block the housing bore 5 against the bias in the spring 10. However, upstream pressure exerted against the ball 9 by liquid carbon dioxide will cause the spring 10 to depress at a predetermined liquid carbon dioxide pressure to unseat the ball 9 and allow liquid carbon dioxide to flow through the housing bore 5 in the direction of the arrow illustrated in FIG. 5, as hereinafter further described. As illustrated in FIG. 7, the liquid cylinders 27 and gas cylinder 39 are grouped in a triangle, secured by cylinder bands 47 and transported in an enclosure 48.

Referring again to FIGS. 1, 5, 6 and 7 of the drawing, when it is desired to charge the liquid cylinders 27 with liquid carbon dioxide and ready the carbon dioxide fill manifold 1 for operation, the liquid service line 31 is attached to a source of liquid carbon dioxide such as a truck, tank, container or the like (not illustrated) and the liquid service valve 32 is opened by manipulating the valve handles 34 to the positions illustrated in FIG. 6. The gas cylinder valves 40 are then opened and liquid carbon dioxide is allowed to flow through the valve bore 11 and the pressure actuated valve 3 of the atomizer 2, since the pressure of the incoming liquid carbon dioxide exceeds the pressure in the housing bore 5 and unseats the ball 9 from the housing seat 8. The liquid carbon dioxide begins to vaporize in the housing bore 5 due to the reduced pressure and continues to vaporize as it flows through the cylinder port 20 and into the gas cylinder 39. When the gas cylinder 39 is filled, the liquid service valve 32 is closed by again manipulating the valve handle 34 and the liquid service line 31 may be detached from the source of liquid carbon dioxide. The liquid carbon dioxide continues to flow through the atomizer 2 and into the gas cylinder 39 through the gas cylinder valve 40, where it continues to vaporize into gaseous carbon dioxide. When the gas cylinder 39 reaches a predetermined pressure indicated by the pressure gauges 45 and the pressure differential across the pressure actuated valve 3 is less than a preselected differential, such as, for example, one hundred pounds, the ball 9 seats in the housing seat 8 and encloses the housing bore 5 to prevent additional liquid carbon dioxide from expanding into the gas cylinder 39. When it is desired to dispense gaseous carbon dioxide from the gas cylinder 39 to a customer, a customer carbon dioxide container or cylinder (not illustrated) is connected by appropriate fittings (not illustrated) to the gas service line 36 and the gas service valve 37 is opened by manipulating the valve handle 34 to facilitate a flow of gaseous carbon dioxide from the gas cylinder 39 through the housing bore 5 and the gas service line port 21 of the atomizer 2 and the gas service line 36, into the customer receptacle. When the customer receptacle is filled, the gas service line 37 is closed by again manipulating the valve handle 34 to the opposite position illustrated in FIG. 6. When the pressure of the gaseous carbon dioxide in the gas cylinder 39 drops to a point where the differential pressure between the gaseous carbon dioxide in the housing bore 5 and the liquid carbon dioxide at the valve bore 11 end of the pressure actuated valve 3 is less than one hundred pounds, the liquid carbon dioxide exerts sufficient pressure to again unseat the ball 9 against the bias in the spring 10 and allow additional liquid carbon dioxide to flow through the housing bore 5 of the pressure relief check valve 3 to expand into vapor and replenish the supply of gaseous carbon dioxide in the gas cylinder 39. This procedure continues until the pressure of the liquid carbon dioxide in the liquid cylinders 27 is sufficiently low that a pressure differential of less than one hundred pounds is always maintained at the pressure actuated valve 3 and additional liquid carbon dioxide must then be charged into the liquid cylinders 27 through the liquid service line 31 and liquid service valve 32 from an external source, by following the cylinder charging procedure described above.

Operation of the carbon dioxide fill manifold in several variations of this invention is further illustrated by the following examples:

EXAMPLE I

Test Set-Up:

Three empty cylinders were strapped together with the carbon dioxide fill manifold installed. The two liquid cylinder valves were opened and the fill truck hose of a liquid carbon dioxide supply truck was connected to the liquid service line. The initial pressure of the vapor cylinder was 700 psi and the vapor cylinder valve was closed during the fill operation.

Observations:

| Accumulated CO2 Weight (LBS) | Flow Pressure At Truck (PSI) |
|---|---|
| 6 | 675 |
| 20 | 650 |
| 40 | 650 |
| 80 | 650 |
| 100 | 650 |
| 120 | 650 |
| 140 | 650 |
| 145 | 775 |
| Liquid Service Valve Closed | |

As the fill point was reached, the speed of the pump was observed to be noticeably different and at 950 psi the bypass valve in the truck system recirculated the liquid flow back to the truck tank to prevent the possibility of exceeding 950 psi in the liquid service line.

EXAMPLE II

Test Set-Up:

Three empty cylinders were strapped together with the carbon dioxide fill manifold installed and all three cylinder valves were opened. A fill truck hose was connected to the liquid service line and the initial pressure of the empty vapor cylinder designated as the vapor or gas cylinder was unknown.

Observations: The gas in the liquid service line was bled off and pressure was observed to increase from 200 psi and to 500 psi in approximately one minute.

| Accumulated CO2 Weight (LBS) | Flow Pressure At Truck (PSI) |
|---|---|
| 136 | 575 |
| 163 | 590 |
| 180 | 590 |
| 200 | 595 |
| 212 | 600 |
| 220 | 600 |
| 236 | 600 |
| 240 | 950 (building in 15 sec.) |
| Liquid Service Valve Closed | |

As the fill point was reached, the speed of the pump was observed to be noticeably different. At 950 psi the bypass valve in the truck system recirculated the liquid flow back to the truck tank to prevent the possibility of exceeding 950 psi in the liquid service line.

The entire fill operation lasted 13.5 minutes.

A small leak was observed in one of the fittings, which leak did not materially affect the readings.

EXAMPLE III

Test Set-Up:

Three empty cylinders were strapped together with the carbon dioxide fill manifold installed and all three cylinder valves were opened. The fill truck hose of a liquid carbon dioxide supply truck was connected to the liquid service line and the initial pressure int he vapor cylinder was noted to be 400 psi.

Observations:

Ordinarily, the procedure would call for closing the valve of the vapor cylinder if its initial pressure is less than 600 psi. However, to obtain flow pressure data, this cylinder was left open to the carbon dioxide fill manifold for most of the test.

| Accumulated CO2 Weight (LBS) | Flow Pressure at Truck (PSI) | Vapor Cylinder Pressure (PSI) |
|---|---|---|
| 10 | 600 | 400 |
| 20 | 600 | 425 |
| 28 | 625 | 450 |
| 32 | 650 | 460 |
| 40 | 650 | 475 |
| 45 | 650 | 475 |
| 50 | 650 | 485 |
| 60 | 650 | 500 |
| 70 | 650 | 505 |
| 80 | 650 | 510 |
| 90 | 650 | 520 |
| 100 | 650 | 520 |
| 110 | 650 | 520 |
| 120 | 650 | 520 |
| 130 | 650 | 520 |
| 140 | 650 | 520 |
| 150 | 675 | 520 |
| 160 | 670 | 520 |
| 170 | 660 | 525 |
| 180 | 660 | 530 |
| Vapor Cylinder Was Closed | | |
| 217 | 700 | 575 |
| 220 | 850 | 600 |
| Liquid Service Valve Closed | | |
| Vapor Cylinder Was Opened | | |
| 220 | 0 | 540 |

It will be appreciated by those skilled in the art that the material used in the carbon dioxide fill manifold 1 of this invention was chosen to withstand a pressure of up to about 1500 psig for all-season use. For example, the liquid service line 31 were constructed of such material as schedule 80 steel tubing and the atomizer 2 and pressure actuated valve 3, as well as all fittings, were constructed of stainless steel. A positive displacement liquid carbon dioxide pump (not illustrated) may be mounted on a tank truck or other liquid carbon dioxide supply vessel (not illustrated) and used to supply liquid carbon dioxide to the liquid service line 31 at a pressure of about 600–850 psi.

While the pressure actuated valve 3 may be adjusted or chosen to operate at any selected pressure drop between the valve bore 11 and the housing bore 5 of the atomizer 2, a pressure drop of about 100 pounds across the pressure actuated valve 3 is preferred, in order to automatically initiate the flow of liquid carbon dioxide into the atomizer 2 as gaseous carbon dioxide is delivered from the gas cylinder 39 to customer receptacles.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A carbon dioxide fill manifold for storing liquid and gaseous carbon dioxide and dispensing gaseous carbon dioxide, comprising atomizer means; at least one liquid chamber port provided in said atomizer means for liquid communication with a liquid chamber having a selected chamber volume for containing liquid carbon dioxide under pressure; pressure actuated valve means provided in said atomizer means for receiving liquid carbon dioxide from the liquid chamber and vaporizing at least a portion of the liquid carbon dioxide responsive to a selected pressure differential across said pressure actuated valve means; and at least one vapor container port provided in said atomizer means for gaseous communication with a vapor container having a selected container volume and adapted to receive the residual liquid carbon dioxide and gaseous carbon dioxide from said atomizer means and dispense the gaseous carbon dioxide to a user.

2. The carbon dioxide fill manifold of claim 1 wherein said chamber volume is about three times as large as said container volume.

3. The carbon dioxide fill manifold of claim 1 wherein said container volume further comprises at least about 32 percent of the total of said chamber volume and said container volume.

4. The carbon dioxide fill manifold of claim 1 further comprising a fill line communicating with said atomizer means and said liquid chamber for introducing liquid carbon dioxide into said atomizer means and said liquid chamber; fill line valve means provided in said fill line for controlling the flow of liquid carbon dioxide through said fill line and said atomizer means into said liquid chamber; and a service line communicating with said atomizer means and said vapor container, for dispensing the gaseous carbon dioxide from said vapor container to the user.

5. The carbon dioxide fill manifold of claim 4 wherein said chamber volume is about three times as large as said container volume.

6. The carbon dioxide fill manifold of claim 4 wherein said container volume further comprises at least about 32 percent of the total of said chamber volume and said container volume.

7. The carbon dioxide fill manifold of claim 4 wherein said pressure actuated valve means further comprises a valve housing seated in said atomizer means, a ball seat provided in said valve housing, a ball movably located in said valve housing adjacent to said ball seat and a spring provided in said valve housing for engaging said ball and normally retaining said ball on said ball seat, whereby said ball is displaced from said ball seat against the bias in said spring when said pressure differential is reached.

8. The carbon dioxide fill manifold of claim 4 further comprising service line valve means provided in said service line for selectively delivering gaseous carbon dioxide to the user.

9. The carbon dioxide fill manifold of claim 4 wherein said pressure actuated valve means further comprises a valve housing seated in said atomizer means, a ball seat provided in said valve housing, a ball movably located in said valve housing adjacent to said ball seat and a spring provided in said valve housing for engaging said ball and normally retaining said ball on said ball seat, whereby said ball is displaced from said ball seat against the bias in said spring when said pressure differential is reached and further comprising service line valve means provided in said service line for selectively delivering gaseous carbon dioxide to the user.

10. The carbon dioxide fill manifold of claim 9 wherein said chamber volume is about three times as large as said container volume.

11. The carbon dioxide fill manifold of claim 9 wherein said container volume further comprises at least about 32 percent of the total of said chamber volume and said container volume.

12. The carbon dioxide fill manifold of claim 4 further comprising pressure relief valve means provided in said atomizer means for controlling the maximum pressure of the liquid carbon dioxide in said atomizer means.

13. The carbon dioxide fill manifold of claim 12 wherein said pressure actuated valve means further comprises a valve housing seated in said atomizer means, a ball seat provided in said valve housing, a ball movably located in said valve housing adjacent to said ball seat and a spring provided in said valve housing for engaging said ball and normally retaining said ball on said ball seat, whereby said ball is displaced from said ball seat against the bias in said spring when said pressure differential is reached and further comprising service line valve means provided in said service line for selectively delivering gaseous carbon dioxide to the user.

14. The carbon dioxide fill manifold of claim 13 wherein said chamber volume is about three times as large as said container volume.

15. The carbon dioxide fill manifold of claim 13 wherein said container volume further comprises at least about 32 percent of the total of said chamber volume and said container volume.

16. The carbon dioxide fill manifold of claim 15 further comprising plug means provided in said atomizer means for installing and removing said valve housing.

17. A carbon dioxide fill manifold for storing liquid and gaseous carbon dioxide and dispensing gaseous carbon dioxide to an end user, comprising an atomizer, at least two liquid chamber ports provided in said atomizer, at least two liquid chambers connected to said liquid chamber ports, said liquid chambers having a selected collective chamber volume for containing liquid carbon dioxide under pressure; a pressure actuated check valve provided in said atomizer for supplying liquid carbon dioxide from said liquid chambers to said atomizer and vaporizing the liquid carbon dioxide in said atomizer responsive to a selected difference in pressure across said pressure actuated check valve; and at least one vapor container port provided in said atomizer, at least one vapor container connected to said vapor container port, said vapor container having a selected container volume which is from about 25% to about 35% as large as said chamber volume and said container volume combined, said vapor container further adapted to receive the vaporized carbon dioxide from said atomizer, contain the gaseous carbon dioxide under pressure and dispense the gaseous carbon dioxide to a user.

18. The carbon dioxide fill manifold of claim 17 further comprising a fill line communicating with said atomizer and said liquid chambers, a fill line valve provided in said fill line for controlling the flow of liquid carbon dioxide through said fill line into said atomizer and said liquid chambers; a gas service line communicating with said atomizer and said vapor container for transferring gaseous carbon dioxide from said vapor container into a customer receptacle; and a pressure relief valve provided in said atomizer for controlling the pressure in said atomizer.

19. A carbon dioxide fill manifold for storing liquid and gaseous carbon dioxide and dispensing gaseous carbon dioxide to an end user, comprising an atomizer; a pair of liquid chamber ports provided in said atomizer, a pair of liquid chambers connected to said liquid chamber ports, said liquid chambers having a selected collective chamber volume for containing liquid carbon dioxide under pressure; a pressure actuated check valve provided in said atomizer in fluid communication with said liquid chambers for supplying liquid carbon dioxide from said liquid chambers to said atomizer and vaporizing the liquid carbon dioxide responsive to a selected difference in pressure across said pressure-actuated check valve; and a vapor container port provided in said atomizer and a vapor container connected to said vapor container port, said vapor container having a selected container volume which is at least about 32 percent as large as said chamber volume and said container volume combined, said vapor container further adapted to receive the vaporized carbon dioxide, contain gaseous carbon dioxide under pressure and dispense the gaseous carbon dioxide to a user.

20. The carbon dioxide fill manifold of claim 19 further comprising a fill line communicating with said liquid chambers; a fill line valve provided in said fill line for controlling the flow of liquid carbon dioxide through said fill line into said liquid chambers, and a service line communicating with said atomizer and said vapor container for dispensing the gaseous carbon dioxide to the user.

21. A method for storing liquid and gaseous carbon dioxide and selectively dispensing gaseous carbon dioxide using a carbon dioxide fill manifold, comprising the steps of:

(a) providing a carbon dioxide fill manifold characterized by an atomizer having at least one liquid chamber port, at least one liquid chamber connected to said liquid chamber port, said liquid chamber containing liquid carbon dioxide, at least one vapor container port, a vapor container connected to said vapor container port, said vapor container containing gaseous carbon dioxide and a pressure actuated valve located in the atomizer between said liquid chamber port and said vapor container port., and (b) charging liquid carbon dioxide into said atomizer and the liquid chamber and allowing said liquid carbon dioxide to flow through said liquid chamber port, said atomizer and said pressure actuated valve into the vapor container responsive to a selected pressure differential across said pressure actuated valve, whereby at least a portion of said liquid carbon dioxide vaporizes in said atomizer and the remainder of said liquid carbon dioxide vaporizes as it flows into said vapor container, for dispensing to a customer.

22. The method as recited in claim 21 comprising the additional step of providing a pressure relief valve in said atomizer in fluid communication with said pressure actuated valve, for relieving excessive pressure in the atomizer.

23. The method as recited in claim 21 comprising the additional step of providing a fill line valve port in said atomizer, a fill line connected to said fill line valve port and a fill line valve provided in said fill line for controlling the flow of liquid carbon dioxide to said atomizer and the liquid chamber.

24. The method as recited in claim 21 comprising the additional steps of:

(a) providing a pressure relief valve in said atomizer in fluid communication with said pressure actuated valve for relieving excessive pressure in the atomizer, and (b) providing a fill line valve port in said atomizer, a fill line connected to said fill line valve port and a fill line valve provided in said fill line for controlling the flow of liquid carbon dioxide to said atomizer and the liquid chamber.

25. The method as recited in claim 21 comprising the additional step of providing a service line port in said atomizer, a service line connected to said service line port and a service line valve provided in said service line for controlling the flow of gaseous carbon dioxide from the vapor container to a user.

26. The method as recited in claim 25 comprising the additional steps of:

(a) providing a pressure relief valve in said atomizer in fluid communication with said pressure actuated valve for relieving excessive pressure in the atomizer; and (b) providing a fill line valve port in said atomizer, a fill line connected to said fill line valve port and a fill line valve provided in said fill line for controlling the flow of liquid carbon dioxide to said atomizer and the liquid chamber.

27. The method as recited in claim 21 comprising the additional step of providing a plug in said atomizer for installing and removing said pressure actuated valve.

28. The method as recited in claim 27 comprising the additional steps of:

(a) providing a pressure relief valve in said atomizer in fluid communication with said pressure actuated valve for relieving excessive pressure in the atomizer;

(b) providing a fill line valve port in said atomizer, a fill line connected to said fill line valve port and a fill line valve provided in said fill line for controlling the flow of liquid carbon dioxide to said atomizer and the liquid chamber;

(c) providing a service line port in said atomizer, a service line connected to said service line port and a service line valve provided in said service line for controlling the flow of gaseous carbon dioxide from the vapor container to a user.

29. A method for storing liquid and gaseous carbon dioxide and selectively dispensing gaseous carbon dioxide using a fill manifold, comprising the steps of:

(a) providing a carbon dioxide fill manifold characterized by an atomizer having a pair of liquid chamber ports adapted to receive a pair of liquid chambers having a first selected composite chamber volume for containing liquid carbon dioxide; a vapor container port adapted to receive a vapor container having a second selected container volume, wherein said second selected container volume is at least 32 percent of the total of said first selected composite chamber volume and said second selected container volume, for containing gaseous carbon dioxide; and a pressure actuated check valve in said atomizer between the liquid chamber and the vapor container;

(b) providing a fill line valve port in said atomizer for receiving a fill line and a fill line valve and controlling the flow of liquid carbon dioxide to the liquid chambers;

(c) providing a pressure relief valve in said atomizer in fluid communication with said pressure actuated valve for relieving excessive pressure in the atomizer;

(d) providing a service line valve port in said atomizer for receiving a service line and a service line valve and controlling the flow of gaseous carbon dioxide from the vapor container to a user; and (e) charging liquid carbon dioxide into said liquid chambers through said fill line and said fill line valve and allowing the liquid carbon dioxide to flow into said atomizer and through said pressure actuated check valve responsive to a selected pressure differential across said pressure actuated valve, whereby at least a portion of the liquid carbon dioxide vaporizes in said atomizer and the remainder of the liquid carbon dioxide vaporizes in said vapor container for dispensing through said service line and said service line valve to a user.

30. The method as recited in claim 29 comprising the additional step of providing a plug in said atomizer for installing and removing said pressure actuated valve.

* * * * *